US008550306B2

(12) United States Patent
Angus et al.

(10) Patent No.: US 8,550,306 B2
(45) Date of Patent: Oct. 8, 2013

(54) DISPENSER CAP FOR A SPRAY DEVICE

(75) Inventors: Peter Angus, Ashington (GB); Adrian Barclay Caroen, London (GB); Andrew Claughton, Leeds (GB); Ian McKinnon, London (GB); Paul Robertson Sherratt, Leeds (GB)

(73) Assignee: Conopco Inc., Englewood Cliffs, NJ (US)

( * ) Notice: Subject to any disclaimer, the term of this patent is extended or adjusted under 35 U.S.C. 154(b) by 1476 days.

(21) Appl. No.: 11/990,032

(22) PCT Filed: Jul. 12, 2006

(86) PCT No.: PCT/EP2006/006878

§ 371 (c)(1),
(2), (4) Date: Feb. 5, 2008

(87) PCT Pub. No.: WO2007/017039

PCT Pub. Date: Feb. 15, 2007

(65) Prior Publication Data

US 2010/0206907 A1 Aug. 19, 2010

(30) Foreign Application Priority Data

Aug. 5, 2005 (EP) ..... 05254885

(51) Int. Cl.
*B67B 1/00* (2006.01)

(52) U.S. Cl.
USPC ..... 222/153.11; 222/402.11; 222/402.13

(58) Field of Classification Search
USPC ..... 222/153.11, 153.13, 153.14, 402.11, 222/402.12, 402.13, 499
See application file for complete search history.

(56) References Cited

U.S. PATENT DOCUMENTS

| | | | | |
|---|---|---|---|---|
| 3,848,778 | A | 11/1974 | Meshberg | 222/402.11 |
| 3,860,149 | A | 1/1975 | Hagianis | 222/153 |
| 4,418,842 | A | 12/1983 | DiLoreto | 222/153 |
| 5,255,823 | A | 10/1993 | Tichy et al. | 222/153 |
| 5,388,730 | A | 2/1995 | Abbott et al. | 222/153 |
| 6,290,103 | B1 * | 9/2001 | Fraillon | 222/321.1 |
| 6,626,330 | B2 * | 9/2003 | Ritsche | 222/153.02 |
| 7,775,402 | B2 * | 8/2010 | Yoshida et al. | 222/153.13 |

FOREIGN PATENT DOCUMENTS

| | | |
|---|---|---|
| EP | 0 987 189 | 1/2003 |
| EP | 1 219 547 | 7/2003 |
| GB | 1 292 843 | 10/1972 |
| WO | 00/66459 | 11/2000 |

OTHER PUBLICATIONS

PCT International Search Report in PCT application PCT/EP2006/006878.

* cited by examiner

*Primary Examiner* — Kevin P Shaver
*Assistant Examiner* — Daniel R Shearer
(74) *Attorney, Agent, or Firm* — Karen E. Klumas

(57) ABSTRACT

A dispenser cap comprising an axially moveable collar that surrounds an inner unit, the inner unit comprising a mounting ring at its bottom that is suitable for placement on a container, a cylindrical wall having a section that defines a radial outlet hole, said radial outlet hole being located towards the upper end of the inner unit, and a release trigger at the upper end of the inner unit, said collar being moveable between a raised position in which it covers the radial outlet hole and a lowered position in which it does not cover the radial outlet hole, the axially moveable collar comprising an internal structure that blocks the depression of the release trigger when the collar is in its raised position.

12 Claims, 10 Drawing Sheets

DISPENSER CAP FOR A SPRAY DEVICE

BACKGROUND

The invention relates to a dispenser cap, and particularly to a dispenser cap suitable for use as part of a spray product.

Spray products are well known and are used in a wide range of fields. In the domestic environment, they are used to dispense textile treatment compositions, including treatments for carpets and clothing; hard surface treatment compositions, including cleaning products and polishes; hair treatment compositions, including styling mousses and hair sprays; and compositions for treatment of other areas of the human body, including perfumes and deodorants, examples of the latter group of compositions including deodorant body sprays and antiperspirants.

The present invention is particularly suited to the application of spray compositions in the domestic environment, especially those require manual activation.

Spray devices commonly used in the domestic environment suffer from the disadvantage that they are vulnerable to accidental operation. In order to prevent this, such devices are often fitted with a cap or lid; however, such lids constitute an inconvenience in that they have to be removed before use, slowing and complicating the use the product.

As an alternative to removable lids, so called "spray-through caps" or sprayheads have been developed by the industry. Examples of such devices that also provide a means of preventing accidental operation are disclosed in GB 1,292,843, U.S. Pat. No. 5,388,730, U.S. Pat. No. 4,418,842, U.S. Pat. No. 3,860,149, U.S. Pat. No. 3,848,778, and EP 1,219,547. In these publications, a sprayhead is rotatable about a supply line from a fluid reservoir within the device. In one position, the sprayhead can be depressed to enable the contents to be discharged, but after rotation around the axis of the supply line, depression of the sprayhead is physically obstructed, thereby preventing discharge. A problem with spray devices of this type is that it is not particularly clear to the user when the device is correctly configured for use.

More complicated sprayheads are described in WO 00/66459 and EP 987,189. In these publications, an axially moveable annulus is used to shield an actuator at the top of an inner unit. In EP 987,189, the annulus is claimed to shield the actuator from being inadvertently depressed; however, it is clear that such shielding is only partial and that the problem of accidental release of the product is not entirely solved by invention disclosed therein.

SUMMARY OF INVENTION

It is an object of the present invention to provide a dispenser cap suitable for use as part of a spray product.

It is a further object of the present invention that the dispenser cap provides a means of protection from accidental release of the product to be dispensed.

It is a further object of the present invention that the dispenser cap is designed in such way as to give the user a visible indication that the product is ready for use or protected from use.

In a first aspect of the present invention, there is provided a dispenser cap comprising an axially moveable collar that surrounds an inner unit, the inner unit comprising a mounting ring at its bottom that is suitable for placement on a container, a cylindrical wall having a section that defines a radial outlet hole, said radial outlet hole being located towards the upper end of the inner unit, and a release trigger at the upper end of the inner unit, said collar being moveable between a raised position in which it covers the radial outlet hole and a lowered position in which it does not cover the radial outlet hole, the axially moveable collar comprising an internal structure that blocks the depression of the release trigger when the collar is in its raised position.

In a second aspect of the present invention, there is provided a spray product comprising a container holding a composition to be sprayed, a dispenser cap as described in the first aspect of the invention, a conduit for transferring the composition from the container to the radial outlet hole, and a means for generating a spray from the composition.

DETAILED DESCRIPTION

The dispenser cap of the present invention involves the raising and lowering of a collar relative to an inner unit which it surrounds. Raising or lowering of the collar is preferably achieved by direct manual handling of the collar. When the collar is lowered, a radial outlet hole in the inner unit is exposed, providing the user with a visible indication that the product is ready for use. Indeed, because the collar is wider than the inner unit, the user is also provided with a tactile indication that the product is ready for use. This tactile indicator enables the product to be easily used in poor light or by the visually impaired.

The dispenser cap of the present invention prevents the accidental release of the product to be dispensed. Accidental release is highly undesirable, reducing the useful life of the product, creating possible hazards during transit of the packaged product, and sometimes adversely affecting the surface upon which the product is accidentally released.

Release of the product to be dispensed is achieved by depression of the release trigger at the upper end of the inner unit. The release trigger may take any form provided that it is capable of triggering the release of the product when the collar is in its lowered position.

Prevention of accidental release of the product is achieved by preventing the depression of the release trigger when collar is in its raised position. In order to deliver the best protection from accidental depression of the release trigger, it is insufficient to merely surround the release trigger with an annular surface (as in EP 987,189). In the present invention, a structure on the internal surface of the axially moveable collar serves to block the depression of the release trigger when the collar is in its raised position. This mechanism of preventing the accidental release of the product is effective and interesting to domestic consumers. Mechanisms found interesting by consumers are ones in which it is not immediately evident how the mechanism works. By having the blocking structure on the internal surface of the collar, it is not visible during use of the dispenser cap and it is not evident to the user how the depression of the release trigger is prevented.

The release trigger may comprise a living hinge and have a self-restoring property causing it to return to its non-depressed position in readiness for re-use.

In preferred embodiments, the movement of the collar between its raised and lowered positions involves rotating it, this being an easy and familiar manual activity for the user. In such embodiments, the collar may comprise an inwardly projecting nub and the inner unit may comprise an edge sloping around its cylindrical wall upon which the nub may sit (the nub protruding sufficiently from the collar for this to be possible). In such embodiments, the nub sits on top of sloping edge beneath it and rotation of the collar around the inner unit causes the nub to rotate around the sloping edge and consequently cause the collar to rise or fall according to the direction of rotation.

The nub may move within a slot defined between the edge upon which it sits, i.e. a lower edge, and an upper edge sloping at the same gradient around the cylindrical wall, on the upper side of the nub. The upper edge of the slot may be defined by an element of the cylindrical wall having a lesser radius of curvature than the element of the cylindrical wall defining the lower edge. This can ease the insertion of the nub into the sloping slot and may also ease manufacture of the inner unit (vide infra). The upper edge of the slot may be the lower edge of a cylindrical wall falling from an arcuate edge of the release trigger, the nub abutting said edge and thereby preventing depression of the release trigger when the collar is in its raised position. When the collar is in its fully lowered position, the edge of the cylindrical wall falling from the arcuate edge of the release trigger does not have the nub beneath it and the release trigger may be depressed and the dispenser thereby activated. In this embodiment, one may rotate the collar from a position in which the nub abuts the sloping edge above it to a position beyond which said sloping edge no longer abuts the nub, thereby enabling depression of the release trigger.

The dispenser cap may comprise two or more lower sloping edges and associated nubs. It is preferred that three such edges and associated nubs are present. When multiple edges and nubs are present, they are preferably spaced evenly around the circumference of the inner unit and the collar in order to cause the least reduction to the structural strength of the dispenser cap.

The radial outlet hole is situated towards the upper end of the inner unit at a height sufficient that the entirety of the hole is exposed when the collar is in its fully lowered position. In generally, the outlet hole is situated in the top 40% of the height of the inner unit, more preferably it is situated in the top 25% of the height of the inner unit. This aids the ergonomic handling of the dispenser cap, enabling covering and uncovering of the outlet hole without extensive axial movement of the collar.

The dispenser cap may be manufactured from any material or materials having the properties required to achieve its function(s). Plastics are typically used, suitable materials being poly(propylene), HDPE, ABS, or polycarbonate. Poly (olefins) are frequently used, particularly poly(propylene).

The collar and inner unit of the dispenser cap are typically manufactured separately, usually by injection moulding, and are then pushed together. When the inner unit has sloping slots as described above and below, its injection moulding is aided by having the upper edge of the slot defined by an element of the cylindrical wall having a lesser radius of curvature than the cylindrical wall defining the lower edge. With this feature, manufacture of the inner unit can involve an inner and an outer moulding block that may be pushed together to define cavities that will become the elements of the cylindrical when they are filled with plastic. When injection moulding is complete, the blocks may be pulled apart to release the moulded article. In this method of manufacture, neither cutting out of material nor side action of inner mould is necessary in order to create the slot.

When a dispenser cap according to the invention is used in a spray product, the spray product must also comprise a container holding a composition to be sprayed, a conduit for transferring the composition from the container to the radial outlet hole, and a means for generating a spray from the composition. The inner unit of the dispenser cap is stationary with respect to the container and sits upon it via a mounting ring, which may take any form.

The radial outlet hole may have a nozzle insert within it. Such nozzle inserts are known in the art and often comprise features that improve spray quality, such as a swirl chamber and associated inlet and outlet channels.

The composition to be sprayed may be pressurised and held within the container by a valve capable of activation by the release trigger.

The composition to be sprayed is typically a domestic composition suitable for manual, rather than automatic, spraying. The composition may be a cosmetic composition, such as a hair or skin care composition, a deodorant, an antiperspirant, or a fragrance. Preferably, the composition is a deodorant and the spray product may be considered a deodorant body spray, where quick and easy use is particularly desirable.

DESCRIPTION OF THE DRAWINGS

Only one embodiment is illustrated in the drawings; however, it should be appreciated that the particular features disclosed therein may have broad applicability in spray products and dispenser caps according to the invention.

DETAILED DESCRIPTION OF THE DRAWINGS

Figure 1:
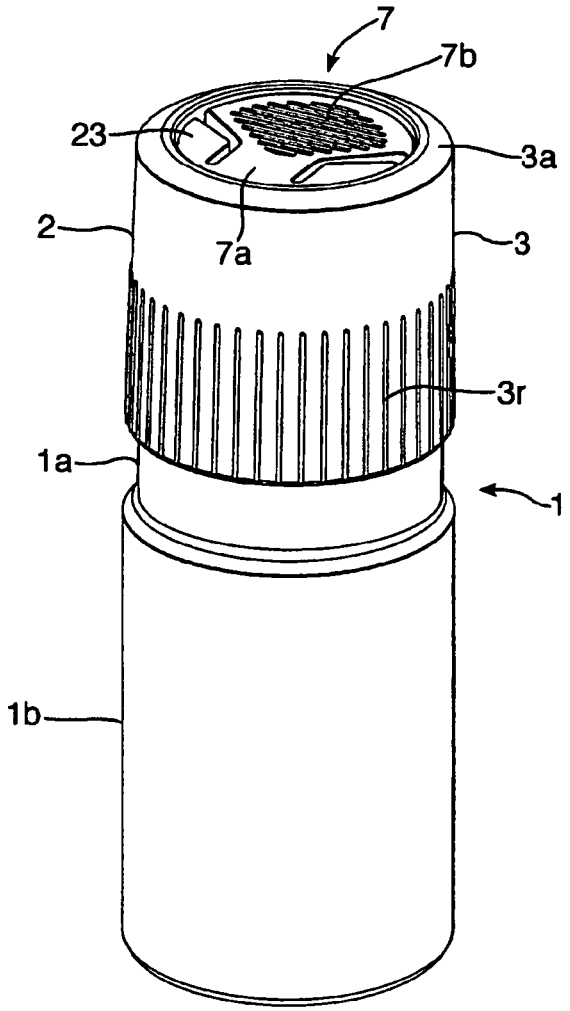
FIG. 1 is a perspective from the front and top of a spray product according to the invention in which the collar is in its raised position.
Figure 2:
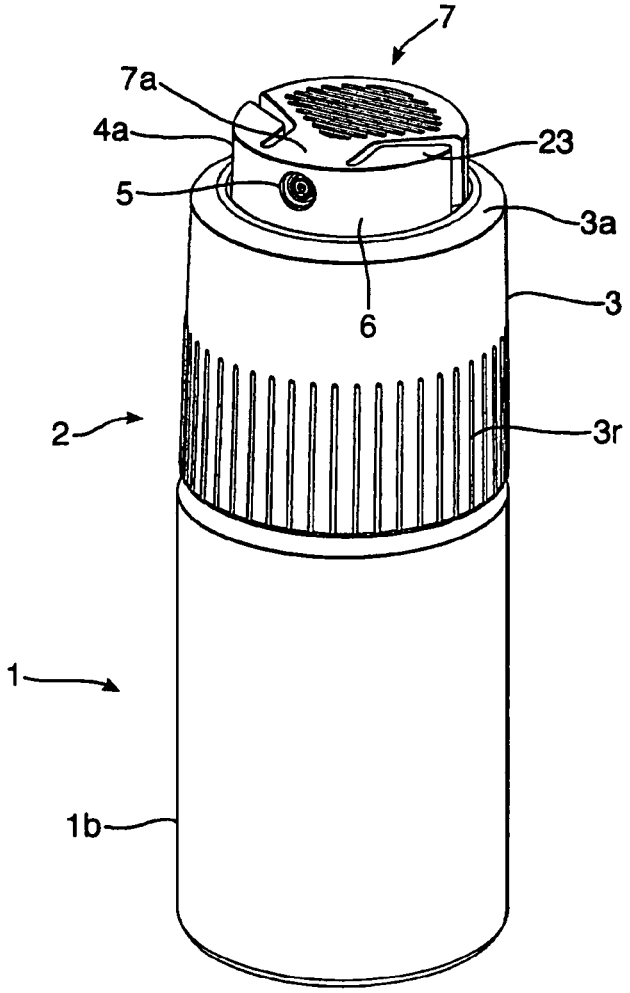
FIG. 2 is a perspective from the front and top of a spray product according to the invention in which the collar is in its lowered position.

FIGS. 1 and 2 illustrate a complete spray product according to the invention. A container (1) holding a composition to be sprayed is capped by a dispenser cap (2) comprising an axially moveable collar (3) surrounding a stationary inner unit (4). The collar (3) may be rotated (vide infra) between a raised position and a lowered position in which the upper part (4*a*) of the inner unit (4) is exposed. The container (1) has a narrowed section (1*a*) at its upper end, around which collar (3) fits, covering most of it when the collar (3) is in its lowered position. The outer diameter of the collar (3) is approximately the same as the outer diameter of the lower end (1*b*) of the container (1). The collar (3) has vertical ribs (3*r*) on its outer surface to aid grip. When the collar (3) is in its lowered position, a radial outlet hole (5) in a cylindrical wall (6) of the inner unit (4) is exposed. The dispenser cap (2) comprises a release trigger (7) at its top in the shape of a stemmed fan, the stem section (7*a*) functioning as a living hinge. The fan section (7*b*) has raised lines across its surface to improve grip on depression of the release trigger (7). The top surface (3*a*) of the collar (3) is chamfered to avoid being hit by the spray when it is released from the radial outlet hole (5).

Figure 3:
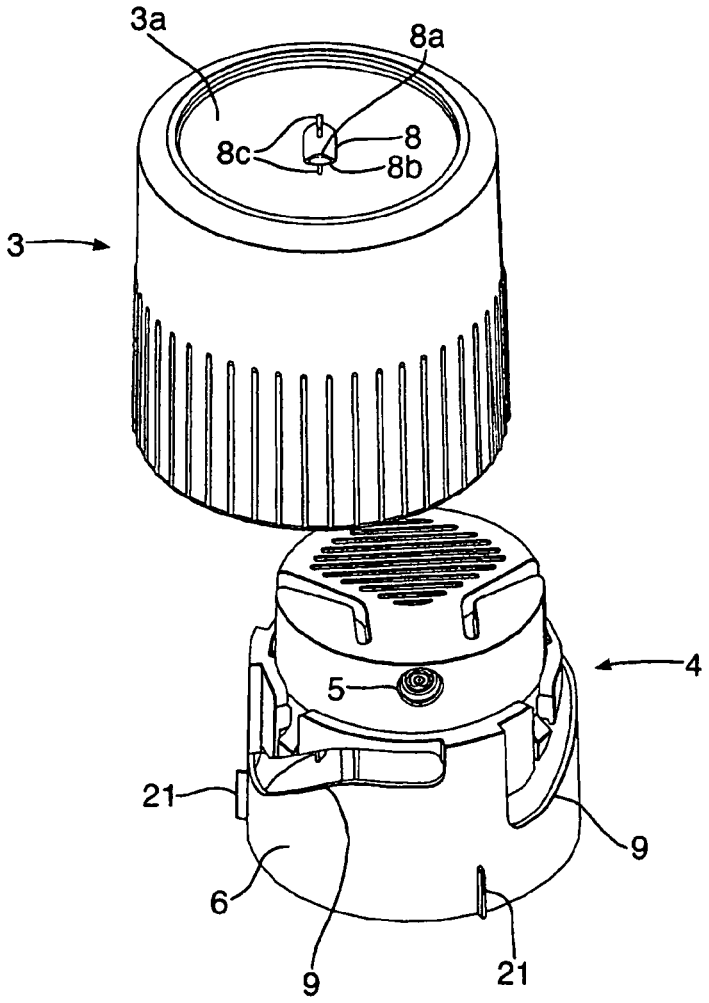
FIG. 3 is an exploded view of the collar and inner unit of a dispenser cap according to the invention.

FIG. 3 is an exploded view of the inner unit (4) and the collar (3). One of three nubs (8) may be seen protruding from the inner surface (3*a*) of the collar (3). It may be seen that the nub (8) is tubular that its end protruding towards the inner unit (3) is obliquely truncated such that its upper part (8*a*) extends further from the inner surface (3*a*) of the collar (3) than its lower part (8*b*). This feature aids the insertion of the nub into a slot (10) in the inner unit (4)(vide infra). The binding of the nub (8) to the inner surface (3*a*) of the collar (3) is strengthened by its tubular nature and by support struts (8*c*) connecting to the inner surface (3*a*) of the collar (3) and located on the top and bottom outer sides of the nub (8). The support struts (8*c*) also serve to hold the collar (3) away from the cylindrical wall (6) of the inner unit (4), easing its rotation there around.

When the collar (3) is in its functioning position around the inner unit (4), the nubs (8) sit on edges (9) sloping around the cylindrical wall (6) of the inner unit (4). Clockwise rotation of the collar (3) around the inner unit (4) causes the nubs (8) to rotate around and drop down the sloping edges (9); as a result the collar (3) falls and the outlet hole (5) becomes exposed. Counter-clockwise rotation of the collar (3) around the inner unit (4) causes the nubs (8) to rotate around and rise up the sloping edges (9); as a result the collar (3) rises and the outlet hole (5) becomes covered.

The nubs (8) move within slots (10*a*, 10*b*, and 10*c*) defined between the edges (9) on which they sit and upper edges (11), sloping at the same gradient around the cylindrical wall (6), on the upper side of the nubs (12). A "side" slot (10*b*) may be seen in FIG. 4. The side slot (10*b*) extends into horizontal, i.e. non-sloping, sections (13*a* and 13*b*) at its lower and upper ends. The upper edge (11) of the side slot (10*b*) has a lip (11*a*) located the breadth of the nub (8) from its upper end, said lip (11*a*) serving as a restraint to the movement of the collar (3) to and away from its highest position.

The upper edges (11) of the slots (10*a*, 10*b*, and 10*c*) are defined by elements of the cylindrical wall (6*a*) that have a lower radius of curvature than the elements of the cylindrical wall (6*b*) defining the lower edges (9). This may be seen in FIG. 4 and, more clearly, in FIG. 5.

Figure 6:
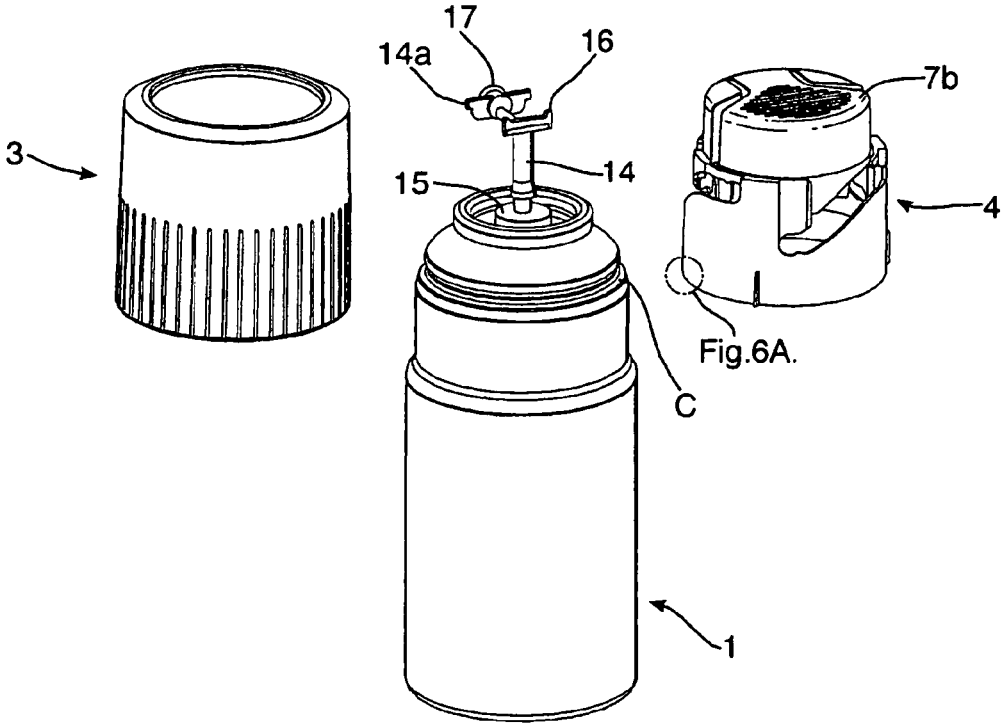
FIG. 6 is an exploded view of the collar, inner unit, container, and transfer conduit of a spray product according to the invention.

The release trigger (7) is used by pressing down on its fan section (7*b*). This, in turn, presses down on a conduit (14) for transferring the composition from the container (1) to the radial outlet hole (5) and this conduit (14), in turn, presses down on a valve stem (15) and thereby allows release of the composition from the container (1). These latter features are shown in FIG. 6. The transfer conduit (14) has a right angle bend; it starts from the valve stem (15) in an axially direction and then bends to a radial direction in order to terminate at the radial outlet hole (5). The transfer conduit (14) has a holding clip (14*a*) that fits into slots (not shown) on either side of the radial outlet hole (5) on the inside of the inner unit (4). On top of the axial section of the transfer conduit (14), there is a strut (16) that is orthogonal to both the axial and radial sections of the transfer conduit (14) and is parallel to the axis of the living hinge (7*a*) of the release trigger (7). This strut (16) serves to aid depression of the transfer conduit (14) when pressure is applied to the release trigger (7). The composition exits through a nozzle insert (17) connected to the end of the transfer conduit (14) and inserted into the radial outlet hole (5).

Figure 6A:
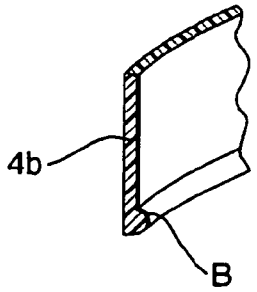
FIG. 6A is section through the bottom of the inner unit of a dispenser cap according to the invention.

FIG. 6A shows that the inner unit (4) has a bead (B) running around its inner side (4*b*) at its bottom. This bead (B) serves to aid the mounting of the inner unit onto a container for the product to be dispensed. It fits into a circular depression (C), shown in FIG. 6, located towards the top of the container and holds the two together.

Figure 7:
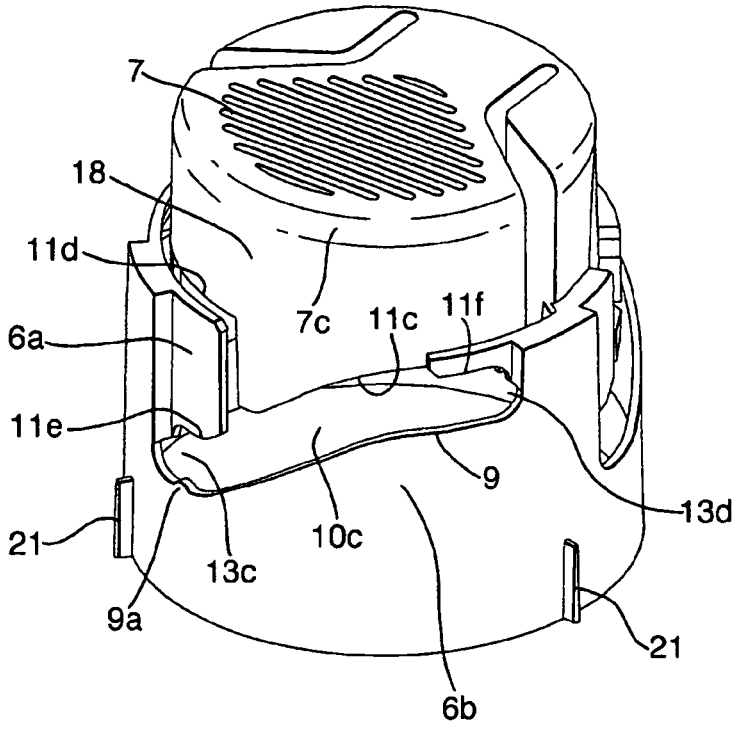
FIG. 7 is a perspective from the rear and top of the inner unit of a dispenser cap according to the invention.

FIG. 7 shows a "rear" slot (10*c*) and the means by which depression of the trigger (7) is prevented, other than when the collar (3) is in its lowered position. This is achieved by the abutment of one of the three nubs (8) (not shown in FIG. 7) against a portion (11*c*) of the upper edge of a "rear" slot (10*c*) that is the lower edge of a sidewall (18) that falls vertically from a curved arcuate edge (7*c*) of the release trigger (7). When the collar (3) is in its lowered position, the nub (8) sits in a horizontal section (13*c*) at the lower end of rear slot (10*c*). In this position, the nub (8) does not have the lower edge of the sidewall (18) abutting it on its top side.

The lower edge of the sidewall (18) attached to the release trigger (7) slopes downwards at the same gradient as the lower edge (9) upon which the nub (8) sits, from a point beyond a horizontal section (13*d*) at the upper end of rear slot (10*c*) to a point before the horizontal section (13*c*) at the lower end of rear slot (10*c*). At both the sloping section and the upper horizontal section (13*d*) of the rear slot (10*c*), the lower edge of the sidewall (18) is separated from the lower edge (9) upon which the nub (8) sits by a distance just sufficient to allow free movement of the nub (8) around the slot (10*c*). At the lower horizontal section (13*c*) of the rear slot (10*c*), the lower edge of the sidewall (18) is sufficiently far from the top of the nub (8) for the trigger (7) and its associated side wall (18) to be capable of being depressed, the lower edge being at a considerably higher level (11*d*) at this section.

The lower horizontal section (13*c*) of the rear slot (10*c*) is defined between a lower edge (9) upon which the nub (8) sits and an upper edge (11*e*) defined by an element of the cylindrical wall (6*a*) having a lesser radius of curvature. The element of the cylindrical wall (6*a*) defining said upper edge (11*e*) ends shortly beyond the point where the rear slot (10*c*) starts to rise.

The lower edge (9) of the rear slot (10*c*) has a lip (9*a*) located the breadth of the nub (8) from its lower end, said lip (19) serving as a restraint to the movement of the collar (3) to and away from its lowest position. The sidewall (18) has a radius of curvature less than that of the element of the cylindrical wall (6*a*) defining the upper edge (11*e*) of lower horizontal section (13*c*) of the rear slot (10*c*).

The upper horizontal section (13*d*) of the rear slot (10*c*) is defined between a lower edge (9) upon which the nub (8) sits and two upper edges (11*c* and 11*f*). One upper edge (11*c*) is the lower edge (11*c*) of the sidewall (18) and has already been discussed. The other upper edge (11*f*) is defined by an element of the cylindrical wall (6*a*) having the same radius of curvature as the element of the cylindrical wall (6*a*) defining the upper edge (11*e*) of the lower horizontal section (13*c*) of the rear slot (10*c*). The element of the cylindrical wall (6*a*) defining said upper edge (11*f*) ends where the rear slot (10*c*) starts to fall.

The truncation of the elements of the cylindrical wall (6*a*) defining the upper edges (11*e* and 11*f*) of the horizontal sections (13*c* and 13*d*) of the rear slot (10*c*) enables the insertion of the nub (8) into the rear slot (10*c*) during manufacture of the dispenser cap.

Figure 4:
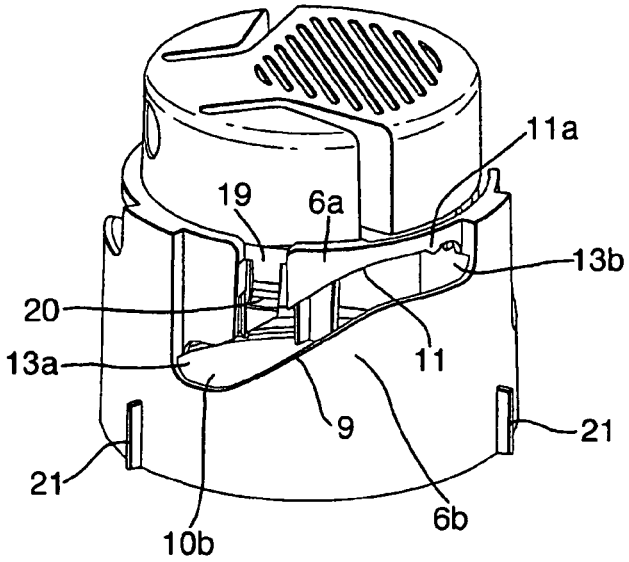
FIG. 4 is a perspective from the side and top of the inner unit of a dispenser cap according to the invention.
Figure 5:
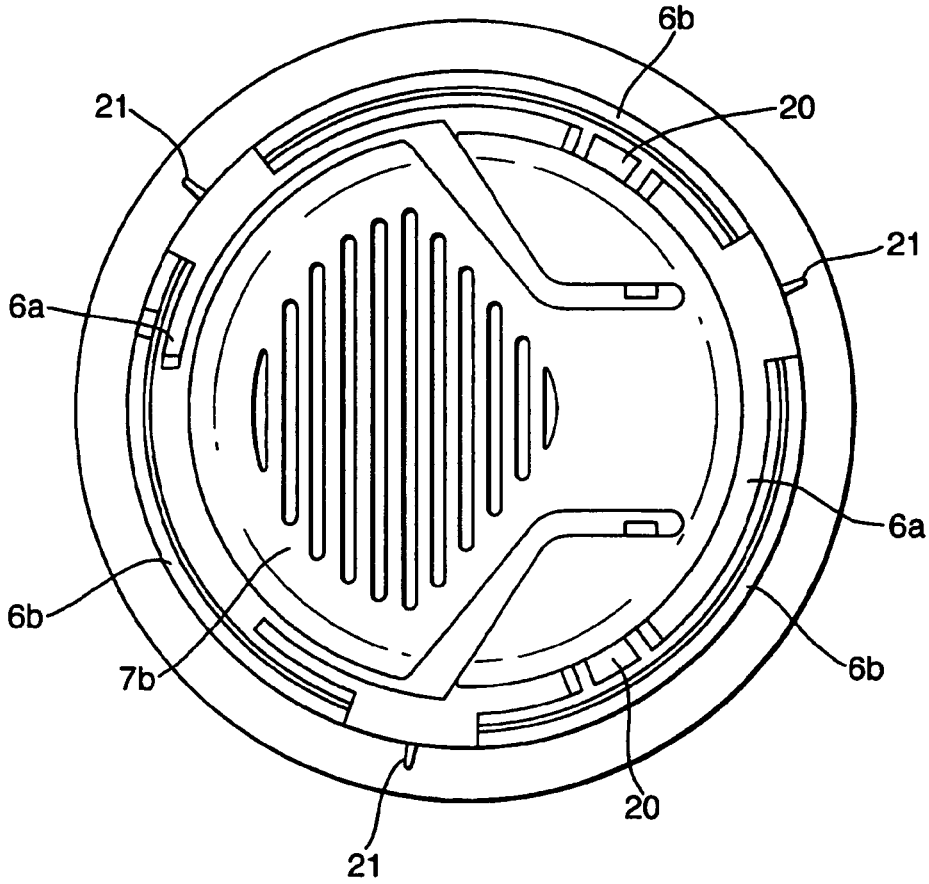
FIG. 5 is a perspective from the top of the inner unit of a dispenser cap according to the invention.
Figure 8:
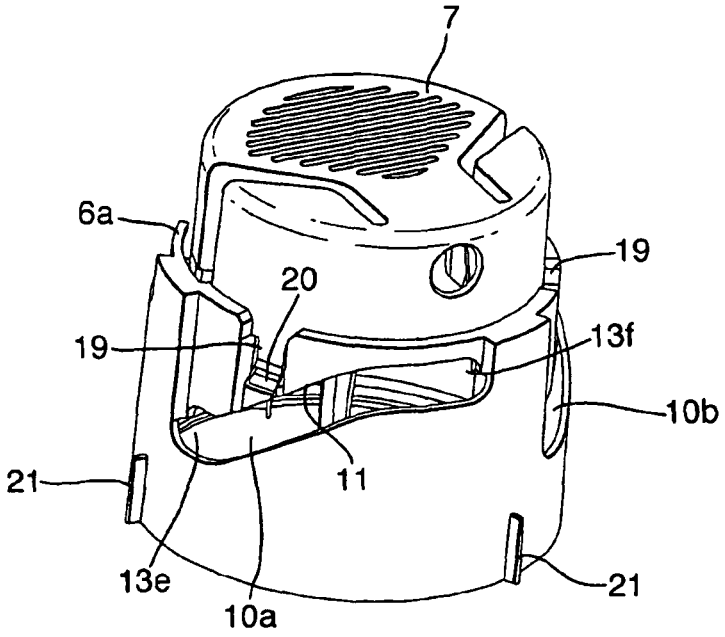
FIG. 8 is a perspective from the front and top of the inner unit of a dispenser cap according to the invention.

Insertion of the nubs (8) into the front slot (10*a*) and the side slot (10*b*) is enabled by vertical recesses (19) in the elements of the cylindrical wall (6*a*) defining the upper edges (11) of said slots (10*a* and 10*b*)(see FIGS. 4, 5, and 8). The vertical recesses (19) are connected to the remainder of the cylindrical wall (6*a*) at their tops, but not at their sides. They have outward sloping steps (20) at their lower ends and are sufficiently flexible to allow the obliquely truncated nubs (8)

(vide supra) to be pushed past said steps (20) during manufacture. FIG. 8 also shows the full length of the "front" slot (10*a*), including horizontal sections (13*e* and 13*f*) at its top and bottom (respectively).

FIG. 8 and certain of the other Figures show vertical ribs (21) on the outer side of the inner unit (4). There are three of these vertical ribs (21) equally spaced around the outer side of the inner unit (4) and radially located between the three slots (10*a*, 10*b* and 10*c*). The ribs (21) extend from the bottom of the inner unit (4) to a point below the lower edge of the slots (10*a*, 10*b* and 10*c*). These ribs serve to provide equal spacing between the collar (3) and inner unit (4) when the device is in use and ease the rotation of the collar (3) around the inner unit (4).

Figure 9:
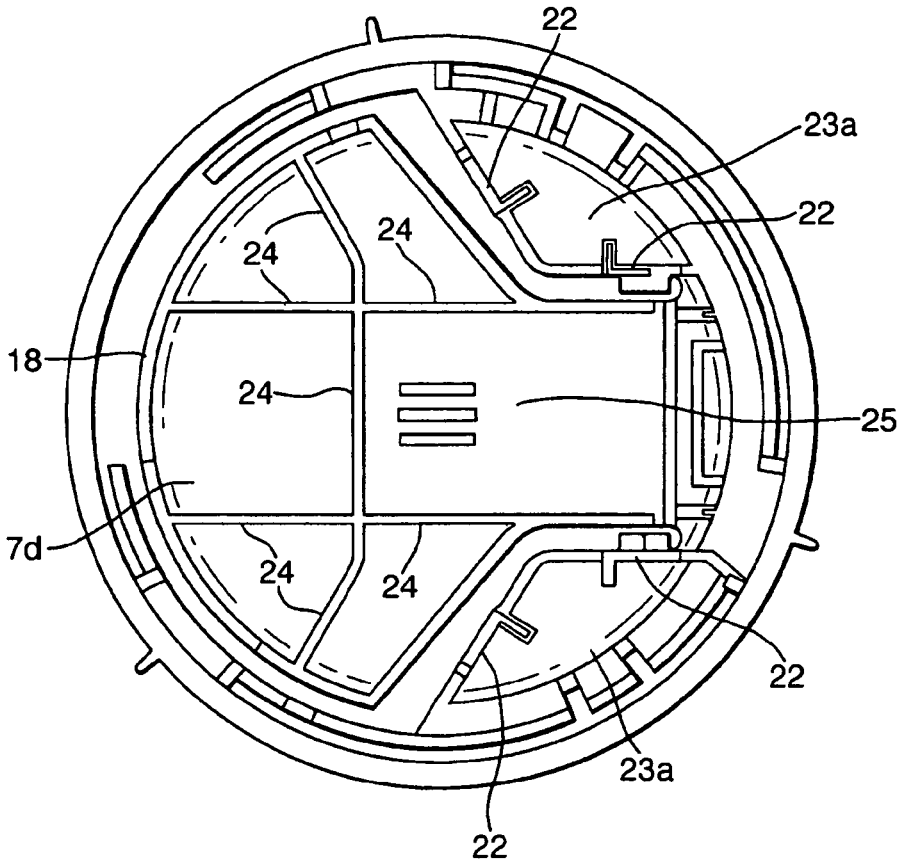
FIG. 9 is a perspective from the bottom of the inner unit of a dispenser cap according to the invention.
Figure 10:
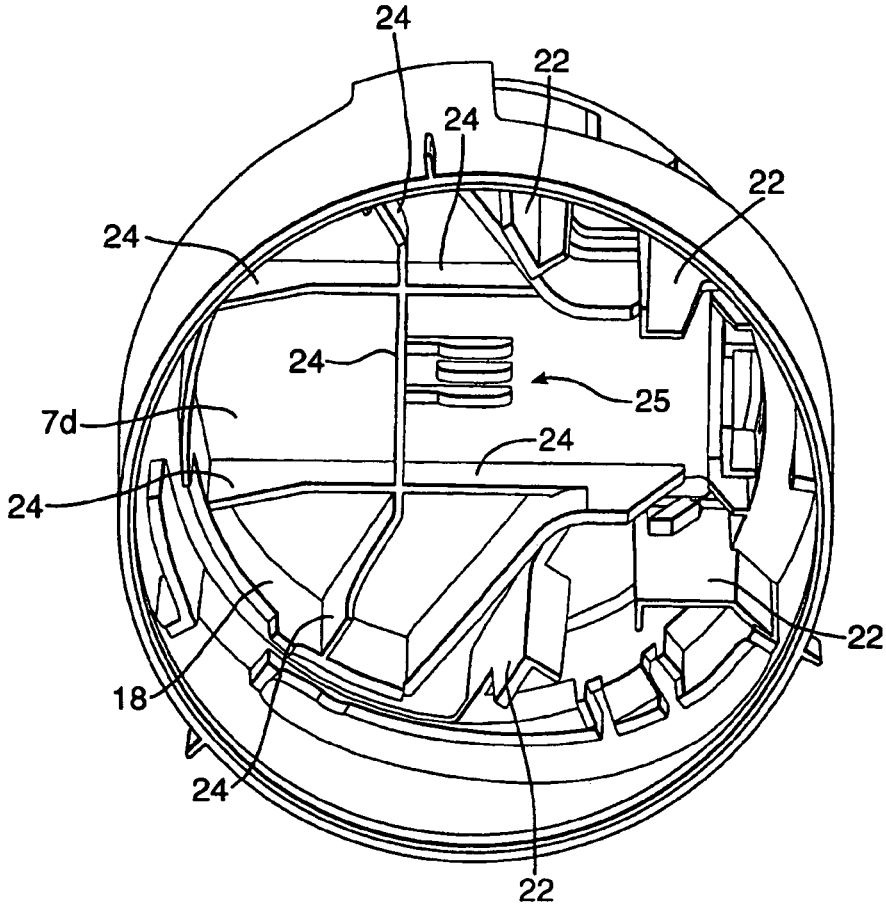
FIG. 10 is a perspective from the bottom and side of the inner unit of a dispenser cap according to the invention.

FIGS. 9 and 10 show strengthening and support features of the inner unit (4). Four V-shaped support pillars (22) fall from the lower side (23*a*) of a top surface of the inner unit (4) located at the side of the stemmed fan release trigger (7). The bottom of the support pillars (22) sit on the top of a valve cup associated with the container (1). The support pillars (22) lend axial strength to inner unit (4). On the lower side (7*d*) of the release trigger (7) there are located several support walls (24). These fall a short distance from the lower side (7*d*) of the release trigger (7) and enhance its planar strength. Towards the sidewall (18) associated with the release trigger (7), the support walls (24) increase in height and thereby support the sidewall (18) and prevent it from buckling past a nub (8) located underneath the lower edge of the sidewall (18) when the collar (3) is not in its lowered position.

Centrally located on the lower side (7*d*) of the release trigger (7) are three beveled walls (25), which aid the functioning of the release trigger (7). On applying pressure to the top surface (7*b*) on the release trigger (7), the beveled walls (25) bear down on the strut (16) at the top of the axial section of the transfer conduit (14) which in turn bears down on the valve stem (15) and opens the valve.

Figure 11:
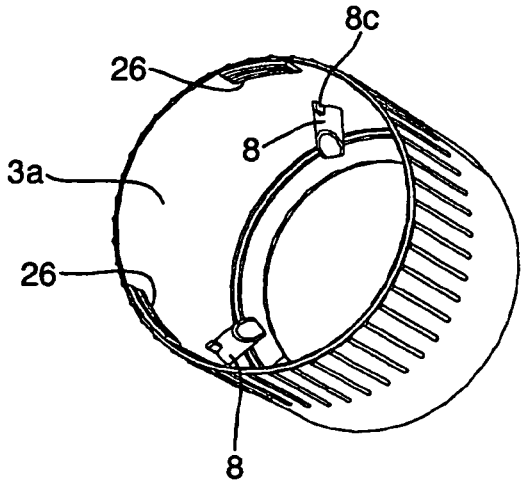
FIG. 11 is a perspective from the bottom and side of the collar of a dispenser cap according to the invention.

FIG. 11 shows two horizontally ribbed protrusions (26) on the inner surface (3*a*) of the collar (3). There are three of these protrusions (26) equally spaced around the bottom inside surface (3*a*) of the collar (3) and axially aligned with the nubs (8), for ease of manufacture. The protrusions (26) contact the narrowed section (1*a*) of the container (1) when the dispenser cap (2) is in place thereon. They serve to ease the rotation of the collar (3) around the narrowed section (1*a*) of the container (1) by reducing the possibility that rotation is inhibited by the collar (3) being squeezed into contact with the narrowed section (1*a*) of the container (1).

The invention claimed is:

1. A spray product comprising:

a container holding a pressurized composition to be sprayed;

a dispenser cap comprising an axially moveable collar that surrounds an inner unit, the inner unit comprising a mounting ring at its bottom that is suitable for placement on a container, a cylindrical wall having a section that defines a radial outlet hole, said radial outlet hole being located towards the upper end of the inner unit, and a release trigger at the upper end of the inner unit, said collar being moveable between a raised position in which it covers the radial outlet hole and a lowered position in which it does not cover the radial outlet hole, the axially moveable collar comprising an internal structure that prevents the depression of the release trigger when the collar is in its raised position;

a conduit for transferring the composition from the container to the radial outlet hole: and a means for generating a spray from the composition;

wherein:

the movement of the collar between its raised and lowered positions involves rotating it;

the inner unit comprises an edge sloping around its cylindrical wall and the collar comprises a nub protruding from its inner surface to an extent sufficient for it to sit on the sloping edge, rotation of the collar around the inner unit causing the nub to rotate around the sloping edge and consequently cause the collar to rise or fall according to the direction of rotation;

the nub moves within a slot defined between the edge upon which it sits and an upper edge sloping at the same gradient around the cylindrical wall, on the upper side of the nub; and the upper edge of the slot is defined by an element of the cylindrical wall having a lesser radius of curvature than the element of the cylindrical wall defining the lower edge.

2. A spray product according to claim 1, wherein there are two or more such edges and associated nubs.

3. A spray product according to claim 1, wherein prevention of the use of the release trigger is achieved by the abutment of a nub against a lower edge of a sidewall that falls vertically from an arcuate edge of the release trigger.

4. A spray product according to claim 3, wherein the nub abuts the lower edge of the sidewall and thereby prevents depression of the release trigger when the collar is in all positions other than its fully lowered position.

5. A spray product according to claim 1, wherein there is a lip on the edge sloping around the cylindrical wall upon which the nub sits, said lip being located the breadth of the associated nub from the lower end of said edge and said lip serving as a restraint to the movement of the nub to and away from its lowest position.

6. A spray product according to claim 1, wherein there is a lip on the upper edge of the slot, located the breadth of the associated nub from the upper end of said sloping edge, said lip serving as a restraint to the movement of the nub to and away from its highest position.

7. A spray product according to claim 1, wherein there are three nubs each moving within an associated slot.

8. A spray product according to claim 1, wherein the composition is a deodorant composition.

9. A spray product according to claim 8, wherein the composition is a body spray.

10. A spray product according to claim 8, wherein the composition is an antiperspirant composition.

11. A spray product comprising:

a container holding a pressurized composition to be sprayed;

a dispenser cap comprising an axially moveable collar that surrounds an inner unit, the inner unit comprising a mounting ring at its bottom that is suitable for placement on a container, a cylindrical wall having a section that defines a radial outlet hole, said radial outlet hole being located towards the upper end of the inner unit, and a release trigger at the upper end of the inner unit, said collar being moveable between a raised position in which it covers the radial outlet hole and a lowered position in which it does not cover the radial outlet hole, the axially moveable collar comprising an internal structure that prevents the depression of the release trigger when the collar is in its raised position;

a conduit for transferring the composition from the container to the radial outlet hole: and a means for generating a spray from the composition;

wherein:

the movement of the collar between its raised and lowered positions involves rotating it;

the inner unit comprises an edge sloping around its cylindrical wall and the collar comprises a nub protruding from its inner surface to an extent sufficient for it to sit on the sloping edge, rotation of the collar around the inner unit causing the nub to rotate around the sloping edge and consequently cause the collar to rise or fall according to the direction of rotation;

the nub moves within a slot defined between the edge upon which it sits and an upper edge sloping at the same gradient around the cylindrical wall, on the upper side of the nub; and the element of the cylindrical wall defining the upper edge of the sloping slot has a vertical recess where the radius of curvature of the cylindrical wall is less, said recess having an outwardly sloping step at its lower end, said vertical recess allowing the insertion of the nub into the sloping slot, and the outwardly sloping step at its lower end preventing its removal.

12. A spray product according to claim 11, wherein the container comprises a valve capable of activation by the release trigger when the collar is in its lowered position.

* * * * *